US008567129B2

(12) United States Patent
Suzuki et al.

(10) Patent No.: US 8,567,129 B2
(45) Date of Patent: Oct. 29, 2013

(54) VEHICLE DOOR CONTROL METHOD AND SYSTEM THEREFOR

(75) Inventors: Shintaro Suzuki, Kasugai (JP); Toshio Machida, Toyota (JP); Eiji Itami, Chiryu (JP); Mizuho Morimitsu, Kariya (JP)

(73) Assignees: Aisin Seiki Kabushiki Kaisha, Kariya-Shi, Aichi-Ken (JP); Toyota Shatai Kabushiki Kaisha, Kariya-Shi, Aichi-Ken (JP)

( * ) Notice: Subject to any disclaimer, the term of this patent is extended or adjusted under 35 U.S.C. 154(b) by 761 days.

(21) Appl. No.: 11/635,629

(22) Filed: Dec. 8, 2006

(65) Prior Publication Data

US 2007/0132273 A1 Jun. 14, 2007

(30) Foreign Application Priority Data

Dec. 14, 2005 (JP) ..... 2005-360353

(51) Int. Cl.
*E05F 11/54* (2006.01)

(52) U.S. Cl.
USPC ..... 49/506; 49/360; 49/280; 49/139; 49/29

(58) Field of Classification Search
USPC ..... 49/29, 30, 32, 139, 279, 280, 360, 506, 49/140; 318/264, 265, 272, 446; 296/155, 296/146.4
See application file for complete search history.

(56) References Cited

U.S. PATENT DOCUMENTS 4,257,631 A * 3/1981 Logan, Jr. ..... 292/251.5
5,434,487 A * 7/1995 Long et al. ..... 318/286
5,801,502 A * 9/1998 Monzen ..... 318/286
5,836,639 A * 11/1998 Kleefeldt et al. ..... 296/155
5,851,049 A * 12/1998 Squire et al. ..... 296/146.4
5,851,050 A * 12/1998 Squire et al. ..... 296/146.4
5,913,563 A * 6/1999 Watanabe et al. ..... 296/155
5,986,420 A * 11/1999 Kato ..... 318/272
7,038,409 B1 * 5/2006 Mullet ..... 318/280
7,607,963 B2 * 10/2009 Ishihara et al. ..... 318/264
7,814,704 B2 * 10/2010 Suzuki et al. ..... 49/26
2004/0123525 A1 * 7/2004 Suzuki et al. ..... 49/360
2004/0262945 A1 * 12/2004 Suzuki et al. ..... 296/155

FOREIGN PATENT DOCUMENTS

JP 03-76980 U 8/1991
JP 09-328961 A 12/1997
JP 1998-280806 A 10/1998
JP 2001-173312 A 6/2001

OTHER PUBLICATIONS

Japanese Office Action dated May 19, 2011 issued in the corresponding Japanese Patent Application and English language translation.

* cited by examiner

*Primary Examiner* — Gregory J. Strimbu
(74) *Attorney, Agent, or Firm* — Buchanan Ingersoll & Rooney PC

(57) ABSTRACT

A vehicle door control method includes operating a vehicle door handle to disengage a door lock device of a vehicle door, beginning to count time upon the operation of the door handle, if the vehicle door has moved from a fully closed position after the door lock device has been disengaged, operating a power assist mechanism to move the vehicle door in an opening direction, if the vehicle door has not moved from the fully closed position, operating the power assist mechanism to urge the vehicle door to move in the opening direction, if the vehicle door moves while being urged by the power assist mechanism, the operation of the power assist mechanism is continued to move the vehicle door in the opening direction, if the vehicle door does not move while being urged by the power assist mechanism, the power assist mechanism is operated in a direction which urges the vehicle door to move to the fully closed position.

1 Claim, 6 Drawing Sheets

VEHICLE DOOR CONTROL METHOD AND SYSTEM THEREFOR

CROSS REFERENCE TO RELATED APPLICATION

This application is based on and claims priority under 35 U.S.C. §119 with respect to Japanese Patent Application 2005-360353, filed on Dec. 14, 2005, the entire content of which is incorporated herein by reference.

FIELD OF THE INVENTION

The present invention is generally directed to a vehicle door control method and system, and more particularly to improvements in a door control method and system for a door with a power assist mechanism utilized in an automobile door, such as a slide door and back door, etc.

BACKGROUND

As an automobile door, such as a slide door, a power assisted slide door has been used, in which the door is slidably opened or closed with a power assist mechanism. This door is sometimes called as a power slide door (PSD). In some of such power slide doors, a so-called remote controlled door operation system is installed for power assisted opening and closing of the door by an operation of a switch provided near the driver's seat or a remote controlling by a wireless switch attached to an engine ignition key or by a user operation (manual operation) of a door handle on the vehicle door.

Concerning the remote control operation for opening and closing a door by the user operation of the door handle as mentioned above, according to one known state of the art, the powered door operation (power assist open/close operation) is started after the door handle has been manually operated by the user from the fully opened or closed door position up to a certain position. One example of this type is disclosed in a Japanese Patent Publication No. 10-280806 A, in which the door handle is manually operated to open the door from the fully closed position to a position where a slide door courtesy switch mechanism or a half-latch switch mechanism is actuated and thereafter the power assist mechanism assumes the rest of the opening operation.

However, in such conventional system, when the door is operated for a vehicle exposed to a very cold weather condition, or for a vehicle with the door being installed insufficiently (not well-built condition), a greater operation force is required to operate the door under such condition and even the manual operation to move the door to a preset position, from where the powered operation assumes, is difficult. If such condition occurs, the power slide door operation would not be started. This is inconvenient for the user of the vehicle who needs to use such power system for some reasons such as convenience.

Accordingly, the invention pertains to improve the vehicle door control method and system which can improve the convenience for the user of the vehicle by improving the door operation of the vehicle door under A bad condition, such as under the vehicle being exposed to a very cold weather or the vehicle door being not well built to the vehicle.

In order to attain such improvements, the inventors of the applicants reviewed various aspects with respect to the conventional problems. For example, in the remote control power assist system using a switch provided near the driver's seat or by a wireless switch to achieve powered operation, the following improvements have been proposed. Normally, in this system, when the driver's seat switch or the wireless switch is operated, latch releasing actuator is operated to release the engagement of the door lock for door open/close operation. After the door lock is disengaged, the power assist mechanism is operated to slide or swing the door in the opening direction giving a power from a power source. Considering this operation mechanism, the inventors added the similar function to the power slide door mechanism of user operation by the door handle. In other words, when the user operates the door handle for opening purpose, the latch releasing actuator is operated to automatically release the lock by an electrical mechanism. Thereafter the power assist mechanism starts its powered door opening operation.

However, in the conventional power slide doors or the power slide doors, which are actually used, generally the lock disengagement operation is manually performed by operating the door handle by the user upon power slide door operation. This is because the door lock disengagement can be mechanically or structurally achieved in a moment when the door handle is operated utilizing the motion (pulling or pushing the door handle) of such operation. Compared with this, it would be very difficult to achieve the same function for the case of the powered door slide operation by the user operation of the door handle. In this case, a detection switch for detecting the user's handle operation has to be additionally provided for actuating the latch releasing actuator and further a judging time has to be set to prevent erroneous operation of the detection switch. Such judging time is set to be a predetermined time (one second or so) to see whether the detection switch correctly detects an intended door handle operation as is the same with the driver's seat switch, which is usually pushed down for a preset time to eliminate any noise or inadvertently generated signal. For the driver, it would be inconvenient to grip the door handle for a time to let the detection switch to inform his or her intent to open or close.

Considering the above problems for the power assist door opening operation, the inventors further reviewed the state of art and reached a new invention.

SUMMARY OF THE INVENTION

According to the invention, a door control method for a vehicle door, which opens and/or closes with a power assistance of a power assist mechanism, which starts a power assistance opening of the vehicle door from a fully closed position when the vehicle door is moved by an operation of a door handle provided on the vehicle door under a condition that a door lock being disengaged in association with the operation of the door handle. One aspect of the invention is that the power assistance is supplied to the vehicle door by actuating the power assist mechanism when the vehicle door is judged to be not moving even after a preset time period lapsed from a counting of a time started from the operation of the door handle.

BRIEF DESCRIPTION OF DRAWINGS

These and other objects of the invention will be more clearly understood by the following description of the preferred embodiments with reference to the attached drawings, in which.

DETAILED DESCRIPTION

Figure 1:
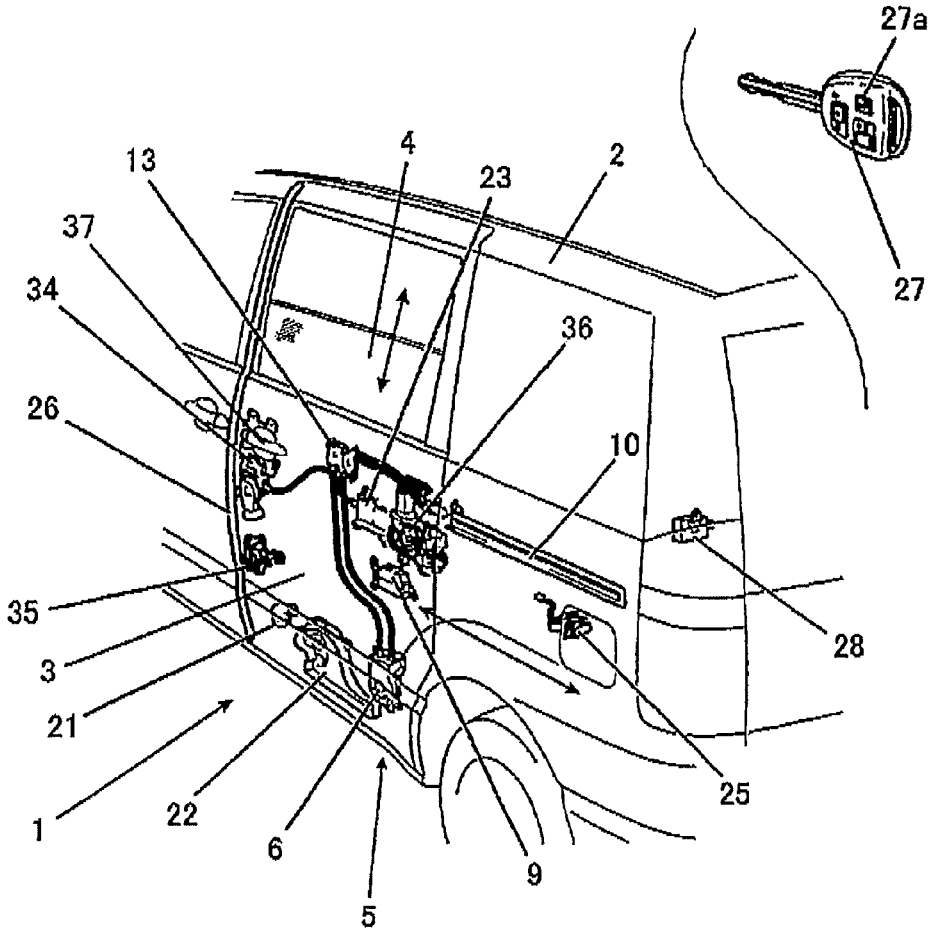
FIG. 1 is a view illustrating a vehicle door control system according to an embodiment of the invention, showing a vehicle side view with the system installed on a side of the vehicle.

The vehicle door control system 1 according to one embodiment of the invention includes a vehicle slide door 3 (power slide door 3 in this embodiment) with a power assist mechanism 5 capable of sliding opening or closing the slide door 3 with the assist power, a drive motor 6 generating the assist power for assisting a user of a vehicle 2 to open or close the door 3, a transmitting mechanism 7 for transmitting the assist power from the drive motor 6 to the vehicle door 3, a door handle 37 (outside and inside) provided on the vehicle door 3, a slide door lock device 36 for restricting the door opening operation under the door being fully closed by the engagement with the vehicle 2 and releasing the engagement in association with the door handle operation (in more detail, when the handle 37 is operated, the door lock is disengaged from the vehicle 2), an operation detecting switch 41 (shown in FIG. 5) for detecting a user's door handle operation and a control device 99 for counting the time upon receipt of a signal from the detecting switch 41 and judging whether the door 3 is moved or not after a preset time passed from the start of counting. The control device 99 actuates the drive motor 6 to give the power to the door 3 for opening or closing when the door is judged to be not moving. The control device 99 judges whether the door is moved or not.

In the embodiment, the door control system 1 is applied to the slide door 3 of a vehicle called "Mini-Van". Numeral 2 designates the vehicle body of the Mini-Van type vehicle. The vehicle door control system 1 with the power assist mechanism 5 is provided on side of the vehicle body 2.

Figure 5:
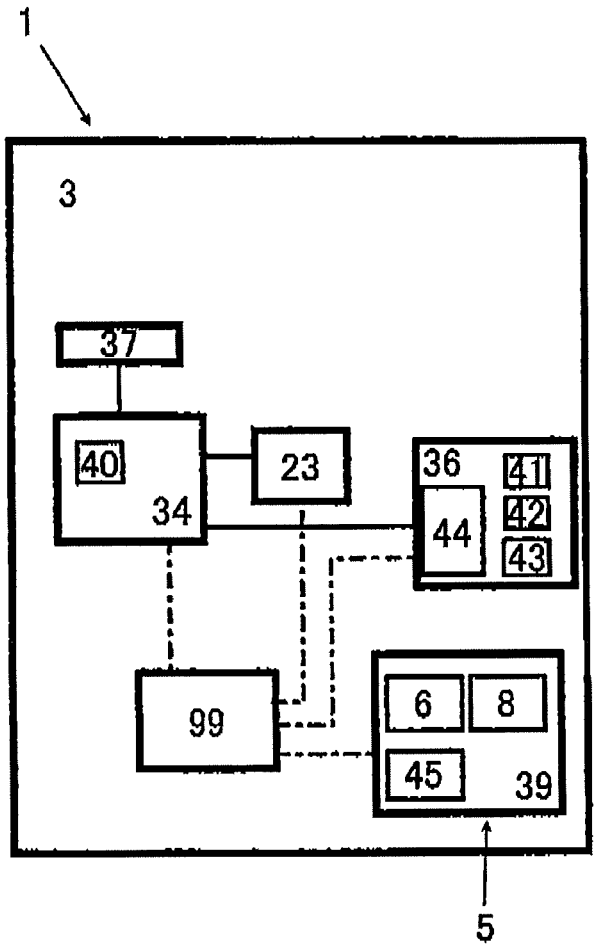
FIG. 5 is a block view showing the system structure.

The vehicle door control system 1 will be now explained in detail hereinafter. FIG. 5 shows the detail of this system and bold lines indicate a mechanical connection while the dashed-dotted lines indicate an electrical connection among the system components.

The door handle 37 on the power slide door 3 is provided for directly open or close the door 3 with hand. The door handle 37 is connected to a slide door lock remote control device 34 via a cable or a rod to mechanically transmit the handle operation motion.

The slide door lock remote control device 34 functions as a transmitting device for transmitting the mechanical motion of the slide door handle 37 to the slide door lock device 36, which functions as an engagement mechanism for engaging the door with the vehicle body 2. The slide door lock remote control device 34 is formed by a plurality of levers operatively connected to one another. This device, for example, changes the pulling motion of the door handle 37 to the release motion of the engagement mechanism of the slide door lock device 36 or transmits the motion to the slide door lock 36. The slide door lock 36 also serves as an easy closer which electrically closes the slide door 3 to fully closed position.

A release actuator 23 is provided for mechanically releasing the engagement of the slide door lock device when the slide door handle 37 is manually operated. This actuator 23 is mechanically connected to the slide door lock remote control device 34. In this vehicle door control system 1, motion of the user's manual operation of the door handle 37 or the mechanical motion of the release actuator 23 is transmitted to the slide door lock device 36 via the slide door lock remote control device 34. In this embodiment, a motor forms the release actuator 23.

A PSD (power slide door) drive unit 39 (shown in FIG. 5) drives the power slide door 3 from a half latched position (door being half opened and the lock being released) to a fully opened position, and further, from the fully opened position to the half latched position. This PSD drive unit 39 includes the drive motor 6, an electromagnetic clutch 8 (coupling device) and a position sensor 45 (all shown in FIG. 5). The position sensor 45 is used for detecting a rotation speed of the drive motor 6, a rotation angle of a motor shaft and the amount of sliding movement of power slide door 3 and a direction thereof.

As mentioned before, the slide door lock 36 is used as the easy closer in addition to the locking function. As shown in FIG. 5, the slide door lock 36 includes a full latch switch 41 (as the operation detecting switch 41), a half latch switch 42, a pawl switch 43 and a closer motor 44. The closer motor 44 moves the power slide door 3 from the half latched position to the fully closed position. The conditions of the door (whether the door is in open position, half latched position or closed position) can be detected by judging the combination condition of these switches 41, 42 and 43. Simple explanation of the operation of the switches will be made hereinafter. When the pawl switch 43 is engaged with a groove (not shown), the door is in fully closed position or in the half opened position. In other words, when the pawl switch 43 is engaged with the groove, the door is detected to be either in the fully closed position or in the half opened position. When the pawl switch 43 is not engaged with the groove, the door is judged to be in neither position. Under the pawl switch 43 being engaged with the groove (which means the door is either in fully opened or half opened position), the door position can be judged to be in the fully closed position when the full latch switch 41 is engaged with a groove and judged to be in half opened position when the half latch switch 42 is engaged with a groove. The full latch switch 41 of this embodiment is also used as the door handle operation-detecting switch. However, one of these switches 41, 42 and 43 or the combination thereof can be used as the same purpose for door handle operation-detecting switch.

In the vehicle door control system 1 as shown in FIG. 5, when the slide door handle 37 is operated, the motion is transmitted to the slide door lock remote control device 34 via the cable or rod (transmitting member). In association with the operation of the handle 37, the slide door lock remote control device 34 switches over a handle switch 40 by, for example, using a lever member to send an electric signal to ECU (shown in FIG. 4 as 9) of the control device 99.

Figure 2:
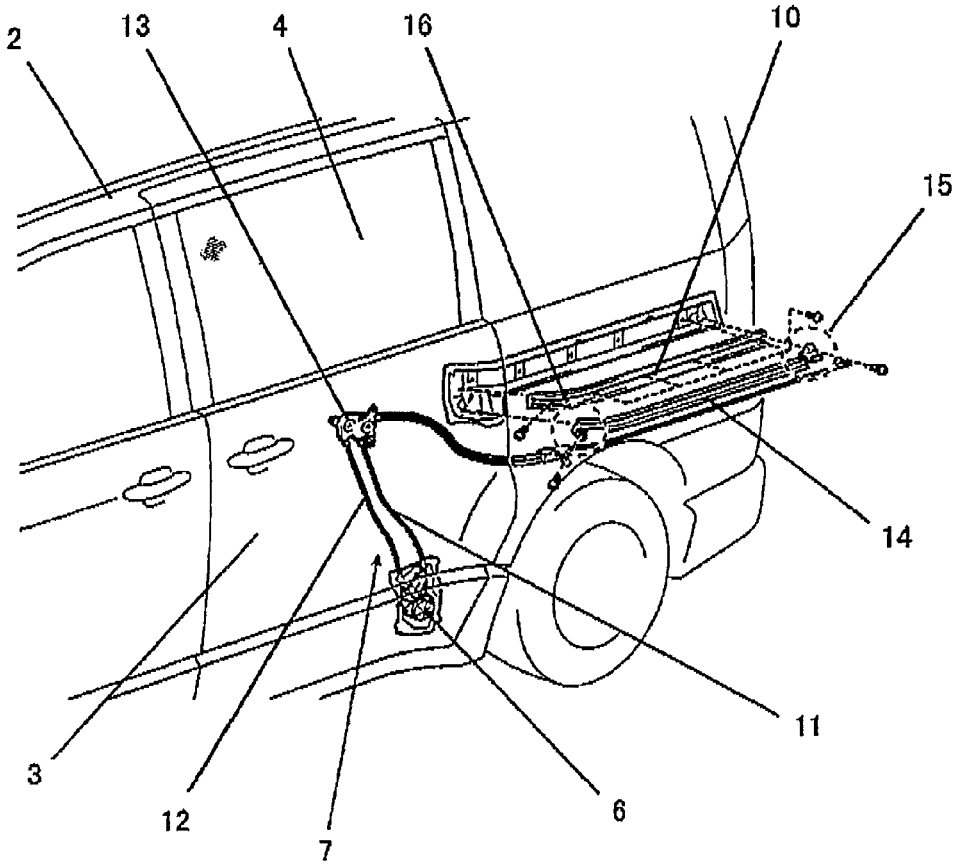
FIG. 2 is a view similar to FIG. 1, but showing from another angle of the vehicle.

Now explaining in more detail about the control system installed in the vehicle body 2, the power slide door 3 is slidably movable in a slide door rail 10 provided at the side of the vehicle body 2. After the slide door slides in this slide door rail 10 for opening, an occupant of the vehicle can enter the inside of the vehicle from an entrance 2*a* (shown in FIG. 2). The power slide door 3 is provided with a window 4 (in this embodiment a side window 4), which can be opened or closed. As a trigger of electrically operating the slide door, a power door switch 18 provided inside of the vehicle (shown in FIG. 4), a push button 27*a* of a transmitter 27 attached to the ignition key or the operation of the door handle 37 provided inside and outside of the vehicle are used. The door starts sliding movement in either open or close direction by operating one of these triggers.

The drive motor 6 is a power source for supplying the power to open or close the power slide door 3. This drive motor 6 and the transmitting mechanism 7 automatically operate the door 3 or assist manual door operation by the user to function as the power assist mechanism 5. The drive motor 6 in this embodiment is housed in the lower part of the door 3 (see FIG. 1). The drive motor 6 is provided with an electromagnetic coupling (magnet clutch, not shown) for integral rotation with the motor output shaft and a Hall IC generating a pulse signal corresponding to the position of the magnet clutch to form the position sensor 45.

The transmitting mechanism 7 transmits the power from the drive motor 6 to the door 3. The transmitting mechanism 7 is formed with an opening cable 11 which is pulled when the door is in opening operation and a closing cable 12 which is pulled when the door is in closing operation, an intermediately placed pulley 13 on which the cables 11 and 12 are wound around and a cable guide plate 14 provided along the slide door rail 10 for guiding the cables (see FIG. 2). The cable guide plate 14 is provided with a tensioner mechanism 15 for adjusting the pulling force for opening cable 11 and another tensioner mechanism 16 for adjusting the pulling force of the closing cable 12.

The coupling device 8 is used for releasing or engaging the slide door 3 and the drive motor 6 via the transmitting mechanism 7. In this embodiment, the electromagnetic clutch is used for this purpose. The electromagnetic clutch 8 or the coupling device connects the power slide door 3 with the drive motor 6 through the transmitting mechanism 7 when energized and disconnects the slide door 3 from the drive motor 6 when de-energized. During the slide door being disconnected from the drive motor 6, the slide door 3 can be manually operated to open or close, regardless of the condition of the transmitting mechanism 7 or the drive motor 6.

A mechanical stopper (not shown) is provided if necessary to limit the sliding movement of the slide door 3. In this embodiment, such stopper is provided for preventing a jamming of a human body between the door and the vehicle body to mechanically stop further sliding movement of the door towards the vehicle body. This stopper can be provided either on the door side or the vehicle body side.

Figure 4:
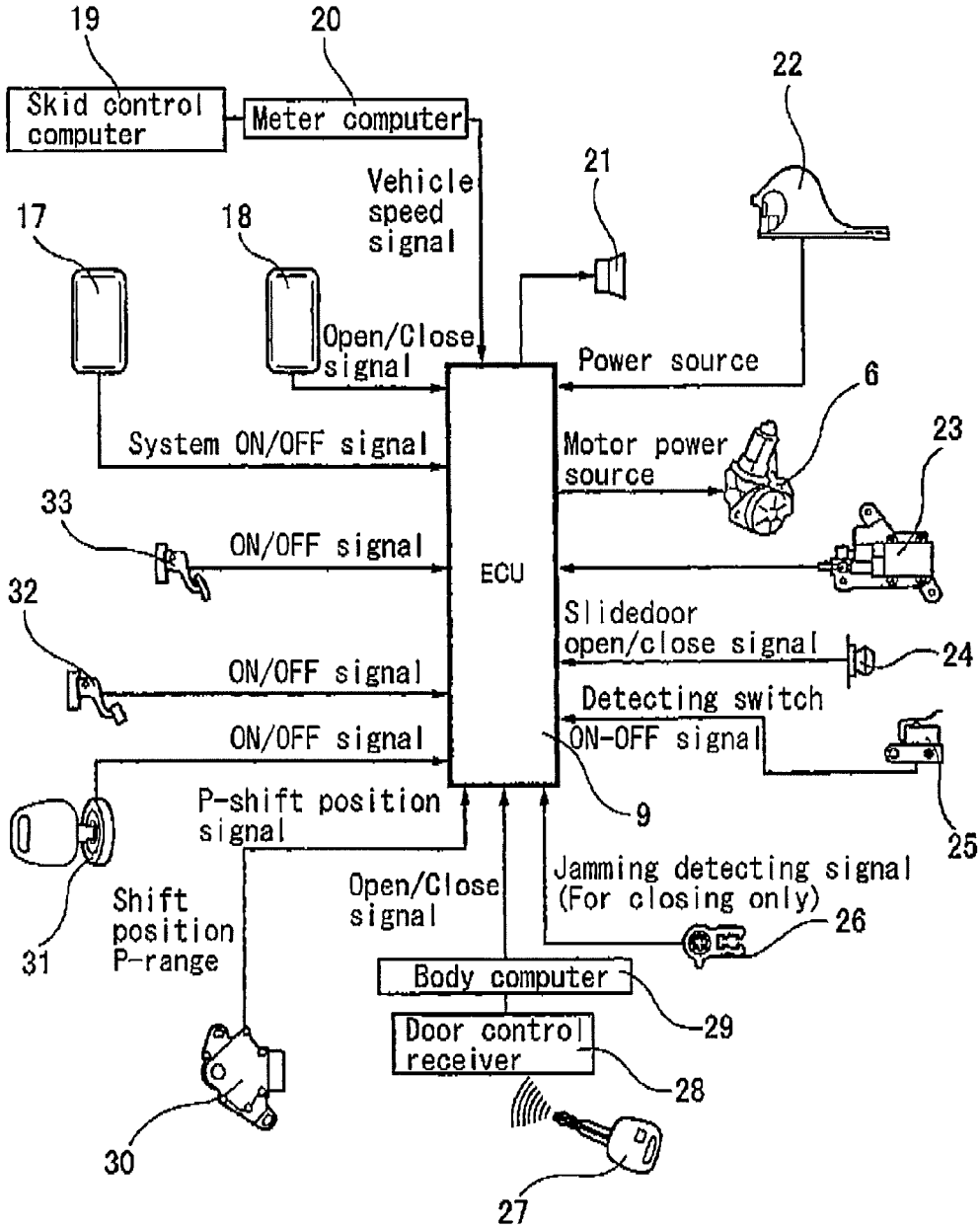
FIG. 4 is a block view of a control device of the vehicle door control system and other related devices.

The control device 99 is used for controlling the operation of the slide door 3 based on judging of the door condition. In this embodiment, the structure of the control device 99 is not shown in detail, but is structured to control the door by using ECU. The control device is housed in the power slide door 3 (FIG. 1) and receives input signal from various devices and sends output signal to various devices as shown in FIG. 4. This function will be explained in more detail hereinafter.

A main switch 17 provided near the driver's seat sends a system ON/OFF signal to the control device 99 (FIG. 4) and the power door switch 18 similarly provided near the driver's seat sends an open/close signal to the control device 99. A skid control computer 19 and a meter computer 20 provided in series send a vehicle speed signal to the control device 99. A warning buzzer 21 warns the user of any danger when necessary. A normally on power-feeding unit 22 for the slide door 3 feeds an electric power to the control device 99. This power-feeding unit 22 is a type that can omit junctions and relays and, accordingly, the system can be simplified and the number of parts can be reduced. The control device 99 after receiving the electric power from the unit 22 in turn sends the power to the drive motor 6 (FIG. 4).

The slide door lock release motor 23 (actuator) is used for releasing the locking of the power slide door 3 to have the door to be in the movable condition. This motor 23 serves as an example of the latch release actuator (FIG. 1 and FIG. 4). Upon the power slide door 3 being opened or closed, the slide door lock release motor 23 is actuated to release the door lock from engagement via the slide door lock remote control device 34. In more detail, upon opening operation of the slide door 3, the slide door lock release motor 23 releases the engagement of the slide door front lock device 35 and the slide door lock device 36 with the door 3 for opening and upon closing operation of the door 3, a full open stopper (not shown) which functions to keep the door to be in the full open condition is released for closing the door (FIG. 1 and FIG. 4). The slide door lock device 36 also serves as the easy closer as mentioned before.

Figure 3:
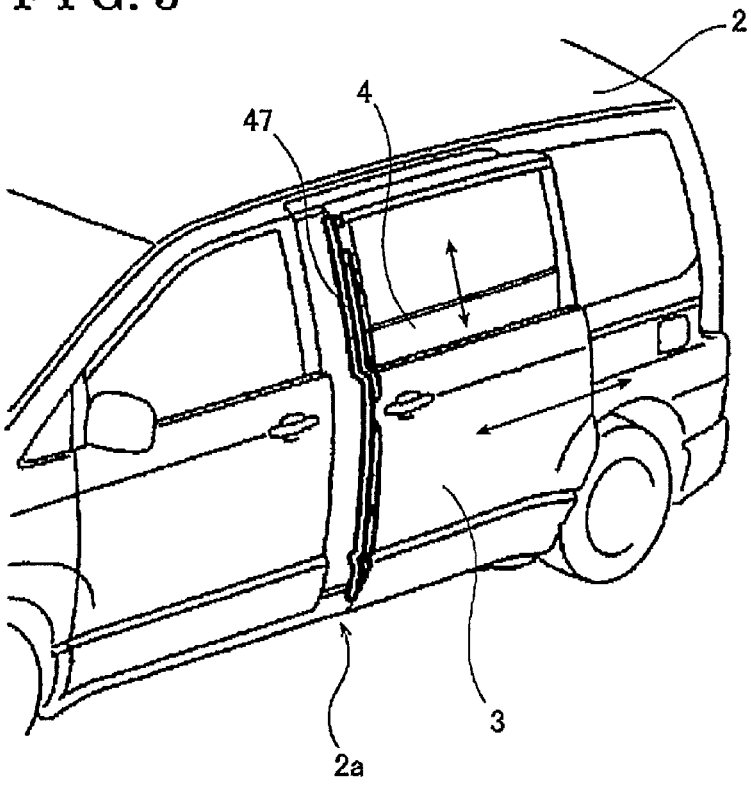
FIG. 3 is a partial perspective view of the vehicle with the vehicle door being opened to a certain amount.

Further, a slide door courtesy lamp switch 24 sends a signal for opening/closing the slide door 3 to the control device 99 and a half open stopper control device 25 sends a door-unlocking signal and a signal for fuel lid opening detection to the control device 99. A touch sensor 26 is provided at a door closing end of the power slide door 3 and sends a signal for jamming detection to the control device 99 only upon door closing operation (FIG. 1 and FIG. 4). Not particularly illustrated, but a weather strip 47 is provided near the touch sensor 26 to seal the door to the vehicle body 2 (FIG. 3). The weather strip 47 is made from a rubber material and has an elasticity to give the unlocked door an elastic force in a door opening direction to assist sliding opening operation upon opening operation of the door, the force being relatively small.

The ignition key has the transmitter 27 therein which wirelessly and remotely controls the operation of the slide door 3. (FIG. 1) The open/close signal generated by this transmitter 27 is sent to the control device 99 via a door control receiver 28 and a body computer 29 (FIGS. 1 and 4). The control device 99 further receives a P-shift position signal from a neutral start switch 30, an ON/OFF signal from an ignition switch 31, an ON/OFF signal from a parking brake switch 32 and an ON/OFF signal from a brake pedal (brake stop lamp switch 33), respectively.

The vehicle door control system 1 further includes a position sensor for detecting the position of the slide door 3. For this purpose, the position sensor 45 is used in this embodiment. One period pulse per one rotation of the motor output shaft is outputted from the Hall IC and based on this output pulse, the calculation is made by the control device 99 to detect the position of the slide door 3.

In addition, a timer count-up function (clock function) is provided in the system 1 for counting an elapsed time during processing. This elapsed time counting function can be achieved by using the ECU 9 housed in the control device 99.

Figure 6:
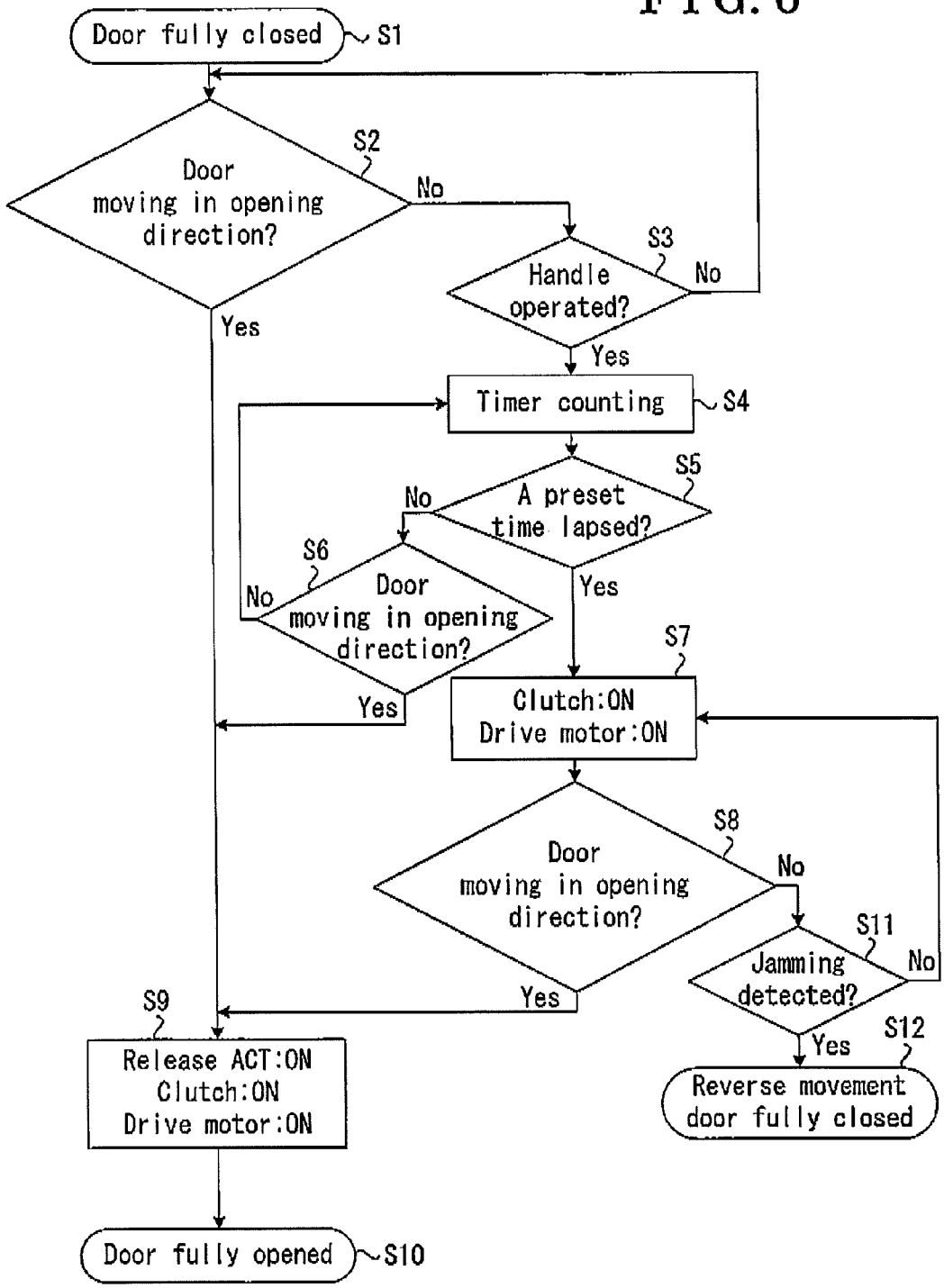
FIG. 6 is a flow chart for explaining the method for controlling the vehicle door control system according to the invention.

Control detail of the system 1 will be explained with reference to the flow chart shown in FIG. 6. As mentioned, there are three triggers (remote control by the power door switch 18, another remote control by the transmitter 27 and direct operation by the manual operation of the door handle 37) to start power assisting door opening operation. The following features are particularly effective to achieve assisting operation, wherein the power assisting operation is performed by user's manual operation of the door handle for opening the door. This is particularly advantageous in case of operation under a severe environment, such as the door being frozen due to the cold weather or the elasticity of the weather strip being deteriorated due to aging phenomena.

The door operation by user's manual operation of the door handle is detected by the operation-detecting switch 41 (for example, full latch switch 41) and thereafter, the movement of the slide door is detected whether the door is moved to a predetermined position (somewhat further opened position than the position of full latch switch 41 being engaged). If the operation-detecting switch 41 does not detect the movement of the door, even after a preset time period has lapsed, then a power is applied to the door in open direction using the drive unit 39 as a trial basis.

The control method according to the vehicle door control system 1 will be explained with reference to FIG. 6. First step S1 is the start of control operation under the door being fully closed. Under this condition (door fully closed), when a user operates the door handle 37 to open the door, such user's force is applied to the slide door lock device 36 through the door lock remote control device 34 thereby to release the door lock engagement. In this embodiment, in the second step S2 the system 1 judges whether or not the door is moved in an opening direction from the fully closed position. This can be judged by the detection of rotation of the full latch switch 41 or magnet clutch (not shown).

When the slide door lock 36 is disengaged by the manual handle operation of the user, the slide door is forced to move in the opening direction due to the elastic force of the weather strip 47 as a reaction force. The full latch switch 41 housed in the slide door lock 36 is switched and the control device 99 confirms the movement of the door in opening direction. Then the control device 99 switches the slide door lock release motor 23, electromagnetic clutch 8 and drive motor 6 to be ON to operate the power assist mechanism 5 (step S9). Then the power slide door 3 is moved in opening direction until the door is fully opened (step S10). This opening operation ends at step S10.

In the step S2, if the power slide door 3 is not moved in the opening direction (N in step S2), then in step S3, the system 1 judges whether the door handle operation was made or not. This can be judged by the control device 99 (ECU) based on the conditions of the handle switch 40 housed in the slide door lock remote control device 34 and the pawl switch 43 housed in the slide door lock device 36. If the movement of the slide door in the opening direction is not detected and repeating operation of the door handle 37 was not made, (N in step S3), the system 1 repeats cycle of the processes between step S2 and step S3 and does not go on to next step. This is the case where the ignition key is ON and no operation to the door handle has been made.

On the other hand, when the system 1 judges at the step S3 that the door handle operation was made (Y in step S3), the time counting function is actuated to start timer counting (step S4). The system 1 continues judging until the preset time lapses (step S5). When the movement of the door 3 in opening direction is detected (Y in Step S6) during this step, the system judges that a desired operation has been made even though the preset time has not lapsed. The system 1 goes to step S9 to actuate the power assist mechanism 5 to achieve opening operation of the door by switching the slide door lock release motor 23 ON (step S9 and step S10). This prevents the system 1 from non-starting of opening operation of the door even though the door lock has been released.

Differing from this situation, when the preset time has lapsed for the power slide door 3 not to move in opening direction (Y in step S5), the power assist mechanism 5 starts a trial operation, wherein the electromagnetic clutch 8 is ON (slide door 3 is connected with the drive motor 6 via the transmitting mechanism 7) to drive the motor 6 in door opening direction. In this step S8, the system 1 judges whether the power slide door 3 is movable or not by the power assist mechanism 5. This trial time (the time period of the drive motor 6 being driven under the electromagnetic clutch 8 being ON) is not of a fixed value. This may vary depending on the rated power of the motor 6 and the specifications of the power slide door 3 or the vehicle 2.

However, since the slide door is movable based on this trial process even when the weather is severe to freeze the door, it is preferable to set a certain time period for this purpose avoiding excess load to the slide door 3 and the motor 6. It is also preferable to set an applying voltage on the drive motor 6, considering the needs to avoid excess load by adjusting freely the external force applied on the other components and devices.

After the trial process (step S7), e.g., after elapse of time during which the motor 6 is driven with the electromagnetic clutch 8 kept ON, the system 1 judges whether the power slide door 3 has been moved in the opening direction (step S8). When judged that the door has been moved in the opening direction (Y in step S8), the door is assumed to return to a normal condition from the temporally stopping due to a frozen door and the power assist mechanism 5 actuates the door to move in the opening direction by switching the slide door lock release motor 23, etc. (step S9 and step S10), as in the same manner from the step S6 or step S2.

At step S8, when the movement of the door 3 is not detected (N in step S8), the jamming detection starts in this embodiment (step S11). This jamming detection can be achieved by detecting the rotation speed of the drive motor 6 as a parameter by the Hall IC. When the rotation speed of the motor 6 is detected to be under a predetermined value, the system 1 assumes that a jamming occurred. This jamming detection has the following advantages: The system 1 can be designed to stop or interrupt the operation if the movement of the door is not detected. However, according to the embodiment, under such condition that the door movement is not detected, the jamming detection is performed before the stopping or interruption of the operation to return the door to the fully closed position. If the door is not moved due to the frozen door by a very cold weather condition under the door lock being released, the door may inadvertently open during the vehicle running due to the melting of the ice on the door. In this embodiment, however, the door is moved in reverse direction to the fully closed position, where the door lock is engaged. The jamming detection in this embodiment is the type normally installed with the power assist mechanism and no additional device is needed. In the present embodiment, when no jamming is detected, the system 1 returns to step S7 (N in step S11). This is because even if the rotation of the drive motor 6 as a parameter stops, the system 1 does not instantly judge that the jamming has occurred, but judges after a preset short period of time. During the preset time period, the system continues repeating the cycle process of step S11, step S7, step S8 and step S11. When the slide door movement is not detected even after the preset time period passed, the system 1 assumes that the jamming has occurred regardless of the occurrence of an actual jamming and moves the door in reverse direction to the fully closed position and engages the lock device (step S11 and step S12).

According to the embodiment of the present invention explained above, the door could be opened by using the power assist mechanism 5 when the user of the vehicle operates slide door handle 37 under the condition that the door cannot be moved due to the frozen condition of the door. If the door is judged not to move after a preset time passed, the power assist operation starts as a trial basis to improve the possibility of the door operable condition due to a temporally non-movable condition by a door frozen under a severe cold weather. This will improve the convenience of the operation by the user.

According to the embodiment, since the operation of the slide door lock release motor 23 (release actuator) starts after the door lock device is mechanically disengaged, erroneous automatic door operation by the motor can be prevented. In addition, even after the slide door 3 does not move to a predetermined position after the disengagement of the full latch switch 41 by the user operation, the power assist operation can be started to achieve the operation in case of the power assist operation by a user's manual operation of the door handle, which leads to an operability of the door operation.

In addition, even after the power assist start operation as a trial basis, the door still continues non-opening condition, then the door is moved in a reverse direction to return the door to the fully closed position via the jamming detection process (step S11). Accordingly, the door lock can be engaged even after releasing of the full latch switch 41 by user's manual door handle operation. This can prevent the door from unexpected or sudden opening after the trial power assist operation by the power assist mechanism 5.

According to the embodiment of the invention, the door control system and method therefor have the following practical advantages: In a usual use of a powered door opening/closing system, a user only operates the door handle and thereafter he or she leaves the remaining opening/closing operation to the power assist system. The user considers a door handle as a mere switch to operate door opening/closing. Actually, the door with the power assist system does not require the user to strongly move the door to open or close. Only required operation for the user is to release the door lock from the door by operating (pulling or touching) the door handle. According to the invention, upon handle operation by the user, even the door would not move for some reason, the power assist mechanism will continue to try to operate the door. This will be effective to operate the door under a severe weather such as the door being frozen due to ice attaching. In addition, the system according to the embodiment provides sufficient safety considerations such as prevention of unexpected door opening or jamming detection.

Although some embodiments of the invention have been explained, it is not limited to the embodiments and various other changes and modifications can be possible within the scope of the invention. For example, the operation of the system has been explained based on one example under the frozen door, but this system is advantageous in case the assembling deviation or deterioration of parts due to aging phenomena. In case of a vehicle with a dual slide door system which has a door on each side, only one side weather strip may be deteriorated due to aging or for some reasons (collision at one side, etc). Such deterioration of the weather strip may cause a non-movement of the door by only the power assist operation. However, according to the invention, since the door handle operation is one of the triggers of starting power assist operation, the door can be surely opened. Accordingly, the invention is advantageous that the power assist operation can be achieved regardless of surrounding environment, such as low temperature and deterioration of some parts or deviation of the assembly.

The invention is also applicable to a door with a handle provided at a rear side of the vehicle (back door) since the power assist mechanism is operated by handle operation of a user.

What is claimed is:

1. A vehicle door control method for a vehicle door which opens with power assistance from a power assist mechanism, the vehicle door comprising a manually operable door handle, the vehicle door control method comprising:

transmitting a mechanical motion of the door handle to a door lock device of the vehicle door to mechanically disengage the door lock device;

beginning to count time upon the mechanical motion the door handle;

if the vehicle door has moved from a fully closed position while the door lock device is the mechanically disengaged, driving a release actuator to keep the door lock device disengaged, and operating the power assist mechanism to move the vehicle door in an opening direction;

if the vehicle door has not moved from the fully closed position within a preset time period after the beginning to count time, operating the power assist mechanism to urge the vehicle door to move in the opening direction without driving the release actuator;

if the vehicle door has moved from the fully closed position by the operation of the power assist mechanism to urge the vehicle door to move in the opening direction without driving the release actuator, driving the release actuator to keep the door lock device disengaged and continuing the operation of operating the power assist mechanism to move the vehicle door in the opening direction, if the vehicle door has not moved from the fully closed position within a predetermine time period despite the operation of the power assist mechanism to urge the vehicle door to move in the opening direction without driving the release actuator, the power assist mechanism is operated in a direction which urges the vehicle door to move to the fully closed position and the door lock device is moved to an engaged state.

* * * * *